US009416746B2

(12) United States Patent
Harmsen et al.

(10) Patent No.: US 9,416,746 B2
(45) Date of Patent: Aug. 16, 2016

(54) METHOD FOR OPERATING AN INTERNAL COMBUSTION ENGINE, METHOD FOR SWITCHING OFF AN INTERNAL COMBUSTION ENGINE AND ENGINE CONTROL DEVICE

(71) Applicant: Ford Global Technologies, LLC, Dearborn, MI (US)

(72) Inventors: Jan Harmsen, Simpelveld (NL); Matthew Allen Schneider, Aachen (DE); Alexey A. Dubkov, Novosibirsk (RU); Monika Angst, Aachen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 717 days.

(21) Appl. No.: 13/911,906

(22) Filed: Jun. 6, 2013

(65) Prior Publication Data

US 2014/0026851 A1 Jan. 30, 2014

(30) Foreign Application Priority Data

Jul. 30, 2012 (DE) ..... 10 2012 213 345

(51) Int. Cl.
*F01N 3/00* (2006.01)
*F02D 41/30* (2006.01)
(Continued)

(52) U.S. Cl.
CPC ..... *F02D 41/30* (2013.01); *F02D 41/0275* (2013.01); *F02D 41/042* (2013.01); *F02D 2041/1412* (2013.01); *F02D 2200/0806* (2013.01)

(58) Field of Classification Search
CPC ..... F01N 2430/00; F01N 2041/026; F01N 3/0842; F01N 13/02; F01N 3/035; F01N 9/002; F02D 41/029; B60Y 2300/476
USPC ..... 60/295, 297, 301, 285, 286, 273, 274; 701/32.4, 32.5, 32.2
See application file for complete search history.

(56) References Cited

U.S. PATENT DOCUMENTS 6,032,461 A * 3/2000 Kinugasa ..... F01N 3/023 60/285
6,195,985 B1 * 3/2001 del Re ..... B60K 6/46 123/DIG. 11
(Continued)

FOREIGN PATENT DOCUMENTS

DE 19948236 A1 * 4/2001 ..... F01N 3/023
DE 10249017 A1 6/2003
(Continued)

OTHER PUBLICATIONS

Anonymous, "Reductant Generation for Solid Zeolite SCR/DPF Catalyst," IPCOM No. 000082821, Published Feb. 28, 2005, 4 pages.

*Primary Examiner* — Patrick Maines
(74) *Attorney, Agent, or Firm* — Julia Voutyas; Alleman Hall McCoy Russell & Tuttle LLP

(57) ABSTRACT

A method for operating an internal combustion engine having a lean NOx trap connected downstream is provided. The method comprises in a normal operating mode, operating the internal combustion engine with a lean fuel/air mixture, and in a special operating mode, operating the internal combustion engine with a rich fuel/air mixture in order to bring about regeneration of the lean NOx trap, wherein a changeover from the normal operating mode to the special operating mode takes place when switching off of the internal combustion engine is expected.

6 Claims, 3 Drawing Sheets

(51) Int. Cl.

| | |
|---|---|
| ***F02D 41/02*** | (2006.01) |
| ***F02D 41/04*** | (2006.01) |
| *F02D 41/14* | (2006.01) |

(56) References Cited

U.S. PATENT DOCUMENTS

2004/0200213 A1* 10/2004 Igarashi ..... F01N 3/023 60/295
2004/0226287 A1* 11/2004 Edgar ..... F01N 3/023 60/295
2005/0166580 A1* 8/2005 Pfaeffle ..... F01N 3/023 60/295
2007/0125074 A1* 6/2007 Marquardt ..... F01N 3/023 60/295
2008/0282674 A1* 11/2008 Gonze ..... B60K 6/48 60/285
2011/0072799 A1* 3/2011 Bidner ..... F01N 3/023 60/286
2014/0090362 A1* 4/2014 Eckhoff ..... F01N 3/0821 60/274

FOREIGN PATENT DOCUMENTS

DE 102008019943 A1 11/2008
DE 102008025569 * 12/2009 ..... F01N 9/00
DE 102008025569 A1 12/2009

* cited by examiner

METHOD FOR OPERATING AN INTERNAL COMBUSTION ENGINE, METHOD FOR SWITCHING OFF AN INTERNAL COMBUSTION ENGINE AND ENGINE CONTROL DEVICE

CROSS REFERENCE TO RELATED APPLICATIONS

The present application claims priority to German Patent Application No. 102012213345.3, filed on Jul. 30, 2012, the entire contents of which are hereby incorporated by reference for all purposes.

FIELD

The present disclosure relates to a method for operating an internal combustion engine having a lean NOx trap connected downstream. In addition, the disclosure relates to a method for switching off such an internal combustion engine and to an engine control device for an internal combustion engine.

BACKGROUND AND SUMMARY

In exhaust systems of internal combustion engines which are operated with a lean fuel/air mixture, that is to say with a mixture with a lambda value >1, what is referred to as a lean NOx trap may be present in the exhaust duct in order to absorb nitrogen oxides (NOx) and therefore improve the emission values of the engine. The lean NOx trap typically has a plurality of ducts through which the engine exhaust gases are conducted and at the surface of which the nitrogen oxides are bound chemically with the aid of, for example, alkali metals such as, for example, barium or strontium. In the case of barium, for example, the nitrogen oxides are bound in the form of barium nitrate.

Since the storage capacity of the lean NOx trap is finite, it is regenerated from time to time, wherein the stored nitrogen oxides, therefore the barium nitrates in the above example, are converted into nitrogen dioxide ($NO_2$) which is subsequently converted into innocuous nitrogen molecules ($N_2$), carbon dioxide ($CO_2$), and water ($H_2O$) using noble metals in the lean NOx trap. This regeneration of the lean NOx trap is carried out by means of hydrocarbons and/or carbon monoxide with which the trap is purged. The hydrocarbons or the carbon monoxide are made available as a result of the fact that the internal combustion engine is temporarily operated with a rich fuel/air mixture (lambda<1). A method for purging a lean NOx trap is described, for example, in DE 102 49 017 A1.

An advantage of the lean NOx traps is, in particular, that the nitrogen oxides can be absorbed from the exhaust gas even during cold starting so that the emissions of the engine are reduced even during cold starting. However, a situation may occur in which the capacity of the lean NOx trap is exhausted when cold starting occurs. This may lead to an increase in nitrogen oxide emissions of the engine since further absorption of the nitrogen oxides by the lean NOx trap may not be possible before purging has taken place, which in turn firstly requires a specific minimum temperature in the trap to be reached. Due to the initial cold engine temperature, the time to reach the minimum temperature may be prolonged, resulting in the release of excess NOx to the atmosphere.

The inventors have herein recognized the above issues and provide a method to at least partly address them. In one embodiment, a method for operating an internal combustion engine having a lean NOx trap connected downstream comprises, in a normal operating mode, operating the internal combustion engine with a lean fuel/air mixture, and in a special operating mode, operating the internal combustion engine with a rich fuel/air mixture in order to bring about regeneration of the lean NOx trap, wherein a changeover from the normal operating mode to the special operating mode takes place when switching off of the internal combustion engine is expected.

In the method according to the disclosure for operating an internal combustion engine having a lean NOx trap connected downstream, the internal combustion engine is operated with a fuel/air mixture. In this context, in a normal operating mode the internal combustion engine is operated with a lean fuel/air mixture (lambda>1), and in a special operating mode it is operated with a rich fuel/air mixture (lambda<1). The special operating mode serves to bring about regeneration of the lean NOx trap, which is also referred to as purging of the lean NOx trap. According to the disclosure, a changeover from the normal operating mode, that is to say the operating mode of the internal combustion engine with the lean fuel/air mixture (lambda>1), to the special operating mode, that is to say the operating mode of the internal combustion engine with the rich fuel/air mixture (lambda<1), takes place when switching off of the internal combustion engine is to be expected.

Since, according to the disclosure, purging of the lean NOx trap takes place whenever switching off of the internal combustion engine is imminent or at least there is a certain probability that it is imminent, it is possible to ensure that in the case of cold starting of the engine a purged lean NOx trap which can absorb the nitrogen oxides occurring during cold starting is available. The method according to the disclosure therefore has a technical result of lowering the nitrogen oxide emissions of the internal combustion engine during cold starting by ensuring that the lean NOx trap is in a purged state during cold starting.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
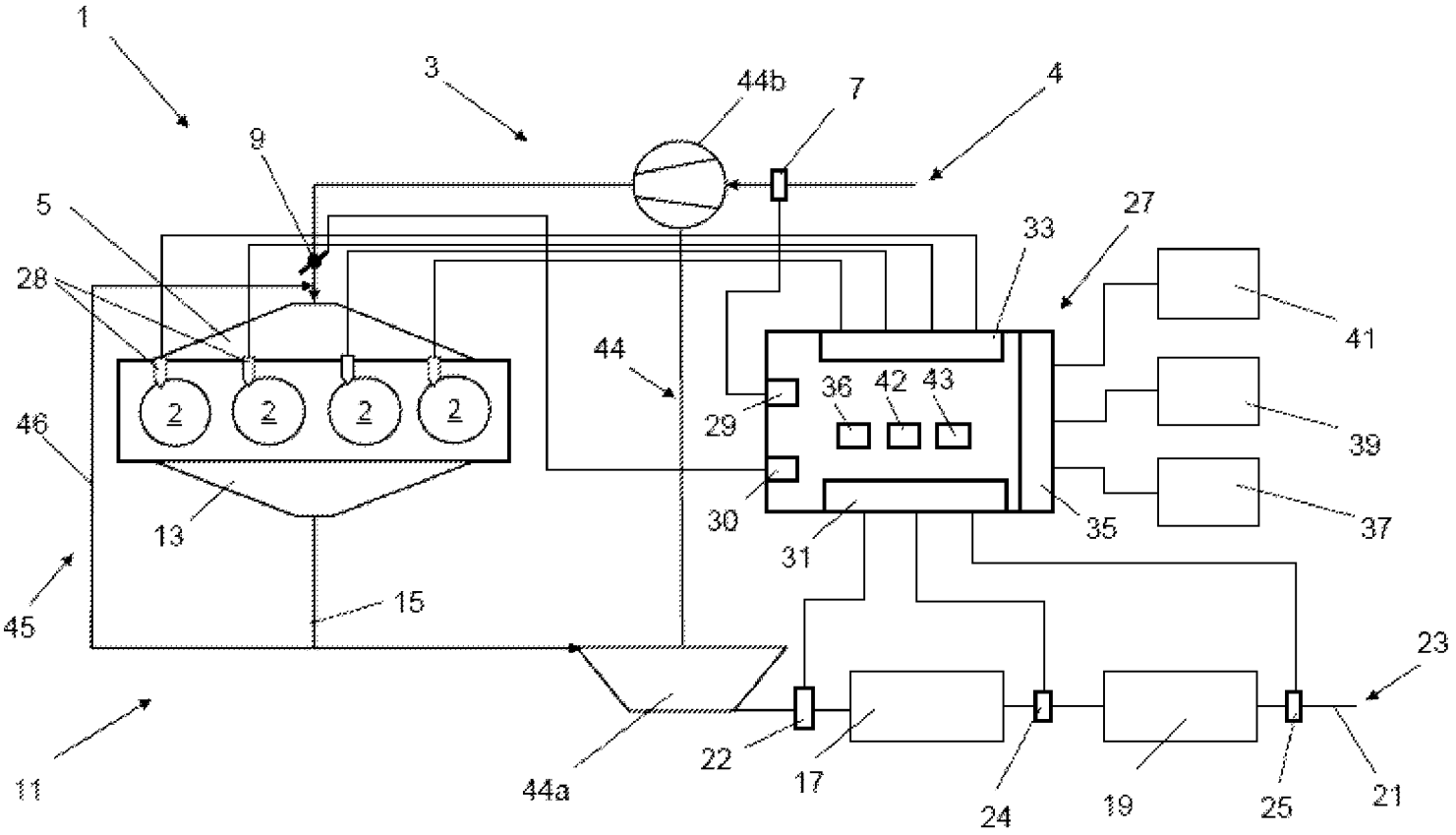
FIG. 1 shows an internal combustion engine with a lean NOx trap connected downstream and an engine control device in a schematic illustration.

Lean NOx traps (LNTs) may be present in engine exhaust systems to trap NOx and prevent its release to the atmosphere. The stored NOx may be converted to non-toxic substances via a reaction with hydrocarbons or other reductants in the LNT introduced from operation with rich combustion. During an engine cold start, NOx that would typically be converted in other exhaust treatment systems (e.g., three-way catalyst) during warmed up engine operation is instead stored in the LNT. However, if a large amount of NOx is stored in the LNT from previous engine operations, NOx may be released during the engine start.

To prevent the release of NOx during an engine cold start, a preventative LNT purge may be performed at engine shut down, even if an LNT regeneration is not indicated. That is, the LNT may be purged responsive to an engine shut down condition by operating the engine with rich combustion. This may occur even if the NOx load on the LNT is not high enough to trigger a purge during the engine operation prior to the shut down condition. Thus, when an engine shutdown is requested or predicted, the engine may be switched from lean combustion to rich combustion.

Switching off of the internal combustion engine is to be expected, in particular, when there is a signal in response to which the switching off of the internal combustion engine generally takes place within a specific time interval following the signal. In one advantageous embodiment of the method according to the disclosure, the changeover from the normal operating mode to the special operating mode is therefore initiated by such a signal. The signal which initiates the changeover from the normal operating mode to the special operating mode can be here, for example, a switch-off signal which is output to an engine control device and initiates the switching off of the internal combustion engine. In this case, the actual switching off of the internal combustion engine by the engine control device is delayed after reception of the switch-off signal until the internal combustion engine has been operated in the special operating mode, that is to say with the rich fuel/air mixture (lambda<1), over a predetermined time period or a signal signals that regeneration of the lean NOx trap has taken place. If the changeover from the normal operating mode to the special operating mode is coupled to the switch-off signal, it is possible to avoid purging of the lean NOx trap taking place without the internal combustion engine actually being switched off subsequently. In this way, superfluous purging processes and therefore superfluous fuel consumption for bringing about the rich fuel/air mixture (lambda<1) can be avoided.

On the other hand, as a result of the changeover to the special operating mode the switching off of the internal combustion engine is delayed by the time period required for the purging of the lean NOx trap if this changeover is initiated by the switch-off signal for the internal combustion engine. Such a delay can be avoided if a signal which occurs chronologically before the actual switching off of the engine over a sufficient period of time is used as the signal which initiates the changeover from the normal operating mode to the special operating mode. Such a signal may be, for example, a signal of a navigation system which indicates that the destination programmed into the navigation system is to be imminently reached. It can generally be assumed that after the destination which has been input into the navigation system has been reached, switching off of the engine takes place. In addition, the fact that the destination is reached is signaled by the navigation system in sufficiently good time so that there is sufficient time remaining up to the actual switching off of the internal combustion engine for purging of the lean NOx trap to be carried out. Another suitable signal which can be used as the signal which initiates the changeover from the normal operating mode to the special operating mode is a signal which indicates the activation of a parking aid. This is generally activated in the case of a parking process, with the result that when a signal which indicates the activation of the parking aid is present it can be assumed with sufficient probability that the internal combustion engine will be switched off soon. In this context, the parking process leaves sufficient time to carry out purging of the lean NOx trap.

In the method according to the disclosure for switching off an internal combustion engine having a lean NOx trap connected downstream, wherein in the normal operating mode the internal combustion engine is operated with a lean fuel/air mixture (lambda>1), and in a special operating mode it is operated with a rich fuel/air mixture (lambda<1) in order to bring about regeneration of the lean NOx trap, after the initiation of switching off the internal combustion engine is operated with the rich fuel/air mixture (lambda<1), that is to say in the special operating mode, over a specific time period or until a signal signals that regeneration of the lean NOx trap has taken place, before the actual switching off of the internal combustion engine takes place. As already described above, in this way it is possible to ensure that in the case of cold starting of the internal combustion engine a purged lean NOx trap is present, with the result that absorption of nitrogen oxides by the lean NOx trap can be ensured during cold starting.

An engine control device according to the disclosure for an internal combustion engine is provided. The engine may comprise a mixture forming device for forming a fuel/air mixture, wherein in the normal operating mode the internal combustion engine is operated with a lean fuel/air mixture (lambda>1), and in a special operating mode it is operated with a rich fuel/air mixture (lambda<1) in order to bring about regeneration of a lean NOx trap which is connected downstream of the internal combustion engine. In an embodiment, the engine control device comprises a signal input for receiving a signal from which imminent switching off of the internal combustion engine can be derived, a control signal generator which is connected to the signal input and which, on reception of the signal from which imminent switching off of the internal combustion engine can be derived, generates a control signal for bringing about a changeover from the formation of a lean fuel/air mixture (lambda>1) to the formation of a rich fuel/air mixture (lambda<1) in the mixture forming device, and a signal output for outputting the control signal to the mixture forming device, which can comprise, for example, fuel injection nozzles and a section of the air path.

The engine control device according to the disclosure is designed for carrying out the method according to the disclosure for operating an internal combustion engine having a lean NOx trap connected downstream and/or for carrying out the method according to the disclosure for switching off the internal combustion engine having a lean NOx trap connected downstream. With the engine control device according to the disclosure it is therefore possible to achieve the properties and advantages described with reference to the methods according to the disclosure.

The signal input can be connected, for example, to a parking aid for receiving an activation signal which indicates the activation of the parking aid, as a signal from which imminent switching off of the internal combustion engine can be derived. Additionally or alternatively, the signal input can be connected to a navigation system for receiving a signal which indicates that the destination programmed into the navigation system is to be imminently reached, as a signal from which imminent switching off of the internal combustion engine can be derived. It is also additionally or alternatively possible to connect the signal input to an engine start/engine stop device, for example an ignition lock, a power on/off button, etc., for receiving a switch-off signal which interrupts the ignition or the fuel supply, as a signal which initiates the switching off of the engine. As has been described above with respect to the methods according to the disclosure, all three signals are suitable for initiating the purging of the lean NOx trap before the internal combustion engine is switched off.

In one advantageous development of the engine control device according to the disclosure, the latter also comprises a stop signal generator. The stop signal generator generates, on the basis of a predefined criterion, a stop signal for bringing about the end of the formation of the rich fuel/air mixture (lambda<1) by the mixture forming device. If the predefined criterion is, for example, a period of time, the stop signal generator can be equipped with a timing device or connected to a timing device which causes the stop signal to be output to the mixture forming device after the expiry of a specific time period from the outputting of the control signal. An alternative criterion on the basis of which the stop signal generator can generate the stop signal can be, for example, a distance traveled if information of a navigation system is present, for example a specific distance or period of time traveled beyond the destination. As a further alternative for the predefined criterion, measured values of at least one sensor which is arranged downstream of the lean NOx trap are taken into account.

The stop signal generator can be integrated into the control signal generator. However, it can alternatively also be embodied as a separate unit which is connected to the control signal generator. In both cases, the outputting of the control signal which brings about the changeover from the lean fuel/air mixture (lambda>1) to the rich fuel/air mixture (lambda<1) would trigger the starting of the timing device. If the signal input of the engine control device is connected to an engine start/engine stop device for receiving a switch-off signal which interrupts the ignition or the fuel supply, as a signal which initiates the switching off of the engine, the engine control device can also comprise a delay unit for delaying the actual switching off of the internal combustion engine until the stop signal has been sent to the mixture forming device. In this context, the delay unit can be supplied, in particular, with the stop signal which is also sent to the mixture forming device, and the delay unit can then bring about the actual switching off of the internal combustion engine when the stop signal is received. This ensures that in the case of cold starting of the internal combustion engine the mixture preparing device makes available a lean fuel/air mixture (lambda>1).

The present disclosure will be explained below with reference to FIG. 1. FIG. 1 shows an internal combustion engine 1, which is illustrated in the present exemplary embodiment in schematic form as a 4 cylinder diesel engine with direct fuel injection. However, the disclosure can also be implemented in conjunction with other engines, in particular engines which have a different number of cylinders or comprise a different type of mixture preparation of fuel and air. In particular, the disclosure is also independent of the type of fuel used, i.e. apart from in diesel engines it can also be used in spark ignition engines.

FIG. 1 also shows in schematic form the intake section 3 with an intake opening 4 and an intake manifold 5 which leads from the intake opening 4 to the individual cylinders 2 of the internal combustion engine 1. An air mass flow rate sensor 7 for sensing the air mass flow rate sucked in through the intake opening 4 is arranged in the region of the intake opening 4. Furthermore, a throttle valve 9 is also arranged in the region of the intake opening 4 in order to be able to regulate the quantity of sucked-in fresh air.

Furthermore, the exhaust section 11 is illustrated in FIG. 1. Said exhaust section 11 comprises an exhaust manifold 13 which connects the individual cylinders 2 to the flame tube 15. The flame tube 15 is adjoined by a lean NOx trap 17, and the latter is in turn adjoined by a soot filter 19, which is a diesel particle filter in the present exemplary embodiment. An end pipe 21 ultimately leads from the soot filter 19 to the exhaust 23. The exhaust section 11 furthermore includes two universal broadband sensors for oxygen (UEGO—Universal Exhaust Gas Oxygen—sensors) 22, 24, one (UEGO sensor 22) of which is connected fluidically upstream of the lean NOx trap 17 and measures the oxygen content in the exhaust gas which flows into the lean NOx trap 17, and the other (UEGO sensor 24) of which is connected fluidically downstream of the lean NOx trap 17 and measures the oxygen content in the exhaust gas flowing out of the lean NOx trap 17. A further universal broadband sensor for oxygen (UEGO sensor) 25 is connected downstream of the soot filter 19. Although UEGO sensors 22, 24, 25 are described in the exhaust section 11 within the scope of the disclosure, other lambda probes or NOx sensors instead of the UEGO sensors can also be used within the scope of the disclosure. In particular, different types of sensors can also be combined with the effect that, for example, a different type of sensor is used for the sensor 25 than for the sensors 22 and 24.

Diesel engines are very frequently equipped with a turbocharger 44. In this case, a turbine **44*a* is made to rotate by the escaping hot exhaust gases and drives a compressor 44*b* via a shaft. This compressor 44*b* compresses the intake air and forces it into the cylinders 2**.

In order to lower the NOx raw emissions of the engine, an exhaust gas recirculation system 45 is frequently used. Via an exhaust gas recirculation line 46, exhaust gas is fed to the intake manifold 5 and is mixed there with the sucked-in combustion air.

The internal combustion engine 1 is controlled by an engine control device 27 which is connected to the air mass flow rate sensor 7 via a signal input 29 in order to receive an air mass flow rate signal which is representative of the sucked-in air mass flow rate. The engine control device 27 is also connected via a signal output 30 to the throttle valve 9 in order to be able to regulate the sucked-in air mass flow rate by means of an actuation signal which is output to the throttle valve 9. Furthermore, a signal input 31 for receiving the measurement signals of the UEGO sensors 22, 24, 25 is present. The engine control device 27 is connected to the fuel injection nozzles 28 of the respective cylinders 2 via a signal output 33. Actuation signals which represent the quantity of fuel to be injected are output to the fuel injection nozzles 28 via the signal output 33. Output signals for setting the fuel/air mixture are generated by a control signal generator 36 on the basis of some of the specified input signals, or of all of the specified input signals.

In the engine control device 27 a further signal input 35 is present, which, in the present exemplary embodiment, is connected to the engine start/engine stop device 37 and/or a navigation system 39 and/or a parking aid 41. In this context, a switch-off signal which interrupts the ignition or the fuel supply can be received, via the signal input 35, from the engine start/engine stop device 37, which may be, for example, an ignition lock or a power on/off button. A signal which indicates that the destination programmed into the navigation system 39 is to be reached imminently can be received from the navigation system 39. The navigation system may be a GPS system or other suitable location and navigation service that assists a vehicle operator in reaching a desired location. An activation signal which indicates the activation of the parking aid can be received from the parking aid 41. The parking aid may receive input from one or more cameras and parking sensors (e.g., sonar sensors) to automatically maneuver the vehicle into a designated parking space.

Each of the three signals mentioned above can be used here by the control signal generator 36 within the scope of a method for operating the internal combustion engine to initiate regeneration of the lean NOx trap 17, as described below.

In a normal operating mode of the internal combustion engine 1, the latter is operated with a lean fuel/air mixture (lambda>1). The setting of the fuel/air mixture is carried out by suitably setting the throttle valve 9 and the fuel injection quantity which is injected into the individual cylinders 2 by the injection nozzles 28.

The nitrogen oxides (NOx) which are produced during operation of the internal combustion engine 1 with the lean fuel/air mixture (lambda>1) are absorbed and stored in the lean NOx trap 17. However, since the lean NOx trap 17 only has a limited storage capacity, it is regenerated from time to time, which is also referred to as purging of the lean NOx trap 17. The free storage capacity of the lean NOx trap 17 can be estimated from the signal of the UEGO sensor 24 connected downstream. If this signal indicates that the storage capacity of the lean NOx trap 17 is exhausted or virtually exhausted, the engine control device 27 can bring about regeneration of the lean NOx trap 17.

In order to regenerate the lean NOx trap 17, the engine control device 27 changes the fuel/air mixture with the result that instead of a lean fuel/air mixture (lambda>1) a rich fuel/air mixture (lambda<1) is burnt in the engine. Owing to the rich fuel/air mixture (lambda<1), the exhaust gas which emerges from the cylinders 2 contains hydrocarbons and carbon monoxide. Both can be used to reduce the nitrogen oxides stored in the lean NOx trap. During this reduction, the stored NOx is converted into innocuous nitrogen molecules ($N_2$), carbon dioxide ($CO_2$) and water ($H_2O$).

However, the described conversion process requires a certain minimum temperature of the lean NOx trap, which is generally present in the customary driving mode. However, in the case of cold starting, the temperature necessary to convert the NOx is not yet reached, with the result that successful purging of the lean NOx trap is not possible directly after cold starting. If the capacity of the lean NOx trap 17 is exhausted or largely exhausted during cold starting, it is, however, not possible to precipitate nitrogen oxides, or not to the full extent, directly after the cold starting. As a result, the emissions occurring during cold starting then increase.

In order to avoid the occurrence of increased emissions during cold starting owing to an exhausted or virtually exhausted storage capacity of the lean NOx trap 17, the engine control device 27 carries out regeneration of the lean NOx trap 17 before the internal combustion engine 1 is switched off. This ensures that during subsequent cold starting there is sufficient capacity present in the lean NOx trap to be able to store nitrogen oxides. In order to carry out the regeneration, a rich fuel/air mixture (lambda<1) is generated in the cylinders 2 over a specific time period before the internal combustion engine 1 is switched off, specifically until the desired degree of regeneration of the lean NOx trap 17 is reached. After the regeneration or the purging of the lean NOx trap has been carried out, the internal combustion engine 1 is then switched off. Since the lean NOx trap 17 is generally hot before the switching off of the internal combustion engine, it is very probable that the purging process is successful. Furthermore, even after the switching off of the internal combustion engine hydrocarbon-containing and carbon-monoxide-containing exhaust gases remain in the exhaust section and permit further regeneration of the lean NOx trap 17 which is still hot directly after the switching off. The regeneration process then takes place until either the hydrocarbons and the carbon monoxide are consumed in the exhaust gas or the temperature of the lean NOx trap 17 has dropped below the temperature necessary for the regeneration process.

The initiation of the purging process before the switching off of the internal combustion engine 1 can be triggered by different events, wherein the possible events depend, inter alia, on the equipment of the motor vehicle.

One possible way, present in all motor vehicles, of initiating regeneration of the lean NOx trap 17 before the switching off of the internal combustion engine 1 is to switch over to a special operating mode of the internal combustion engine 1 with a rich fuel/air mixture (lambda<1) when the engine control device 27 receives from the engine start/engine stop device a switch-off signal which interrupts the ignition and/or the fuel supply. This signal, which would normally lead directly to the switching off of the internal combustion engine 1, does not lead to switching off of the internal combustion engine 1 in the scope of the present method until after a delay by a delay unit 42. In the meantime, that is to say in the interval between the reception of the switch-off signal by the engine control device 27 and the actual switching off of the internal combustion engine 1, the internal combustion engine 1 is operated with a rich fuel/air mixture (lambda<1) in order to carry out the regeneration of the lean NOx trap 17. In this context, the engine control device 27 can be equipped with a stop signal generator 43 which starts an integrated timing device (timer) in response to a control signal for bringing about the changeover from the normal operating mode to the special operating mode with the rich fuel/air mixture (lambda<1). After the expiry of a time period stored in the timing device, the stop signal which ends the special operating mode is then output.

It is to be noted at this point that the timing device does not necessarily have to be integrated into the stop signal generator 43. Instead, it can be embodied as a separate device which has a signal transmitting connection to the stop signal generator 43. It is also not absolutely necessary here to use a stop signal generator 43 such as has been described above. For example, there is the possibility of maintaining the special operating mode until the actual switching off of the internal combustion engine 1 takes place. In this case, only when the internal combustion engine 1 switches on again is there a changeover into the normal operating mode, i.e. the internal combustion engine is operated with a lean fuel/air mixture (lambda>1).

If the motor vehicle is equipped with a navigation system 39, the initiation of the regeneration of the lean NOx trap 17 can take place in response to a signal of the navigation system 39. In the present exemplary embodiment, the navigation system 39 sends a signal, which represents that the programmed-in destination is to be imminently reached, to the engine control unit 27 as soon as the reaching of the destination is imminent within a specific time period. If such a signal is present at the signal input 35 of the engine control device, the engine control device 27 initiates the changeover from the normal operating mode to the special operating mode in order to bring about the regeneration of the lean NOx trap 17. The special operating mode can then be maintained, for example, over a predefined time period or until ultimately the internal combustion engine 1 is switched off. The switching off of the internal combustion engine 1 generally takes place after a period of time which is not particularly long, after the navigation system 39 has signalled that the programmed-in destination will be reached soon. If the vehicle travels beyond the destination programmed into the navigation system 39, the special operating mode can, for example, be ended even after a predefined minimum distance to the destination or the corresponding time period has been exceeded.

Yet a further possible way of initiating the regeneration of the lean NOx trap 17 comprises changing over from the normal operating mode to the special operating mode with the rich fuel/air mixture (lambda<1) if, given the presence of a parking aid 41, an activation signal which indicates the activation of the parking aid is received from the engine control device 27. Since in the case of activation of the parking aid 41 it can be assumed that the internal combustion engine 1 will be switched off soon, this signal can be used satisfactorily to initiate the regeneration process. It is also the case here, as when performing regeneration on the basis of the signal received from the navigation system, that the special operating mode is maintained either over a predetermined time period or until the internal combustion engine 1 is switched off.

In all the described variants for initiating the purging process for the lean NOx trap there is the possibility of ending the purging process if the signal of the sensor 24 connected downstream of the lean NOx trap 17 indicates that the lean NOx trap 17 has been successfully purged, i.e. a sufficient storage capacity is present again. This may be concluded, for example when a NOx sensor is used as a sensor 24, from the failure to detect NOx or from the detection of only small quantities of NOx in the exhaust gas flowing out of the lean NOx trap 17. Even when an UEGO sensor is used as the sensor 24, the storage capacity of the lean NOx trap 17 can be inferred from the sensor signal, in particular from the chronological profile thereof.

It is advantageous both when using a signal of a navigation system 39 and when using an activation signal for a parking aid 41 if a maximum time period is predefined over which the special operating mode for regenerating the lean NOx trap 17 takes place. In this way it is possible to prevent the internal combustion engine being operated for an unnecessarily long time with a rich fuel/air mixture (lambda<1) when the internal combustion engine is not actually switched off immediately after reception of the corresponding signal.

Both the regeneration of the lean NOx trap 17 in response to the reception of a signal of the navigation system 39 and the initiation of the regeneration when an activation signal for the parking aid 41 is received provide the advantage that the switching off of the internal combustion engine 1 does not have to be delayed especially by a delay unit 42 in order to have sufficient time for the regeneration of the lean NOx trap 17. The time period between the reception by the navigation system 39 of a signal which indicates that the destination has been reached up to the actual switching off of the internal combustion engine 1 is, like the time period between the activation of the parking aid 41 and the actual switching off of the internal combustion engine 1, generally long enough to carry out the regeneration of the lean NOx trap.

Although the present disclosure has been described with respect to specific exemplary embodiments, the disclosure is not to be restricted to the exemplary embodiments described. As already mentioned, the disclosure is independent of the number of cylinders in the internal combustion engine 1. However, the arrangement of the cylinders in the internal combustion engine may also be different from that in the present exemplary embodiment in which a series arrangement of the cylinders is illustrated. For example, V-shaped arrangements or Boxer arrangements of the cylinders are also possible, as are other arrangements not specified here. It is also possible for the mixture preparation to take place in a way other than by direct injection of the fuel into the cylinders. Furthermore, other signals which allow imminent switching off of the internal combustion engine to be inferred can be used to bring about the regeneration of the lean NOx trap. Which signals are available for this depends, inter alia, on the equipment of the respective motor vehicle.

Figure 2:
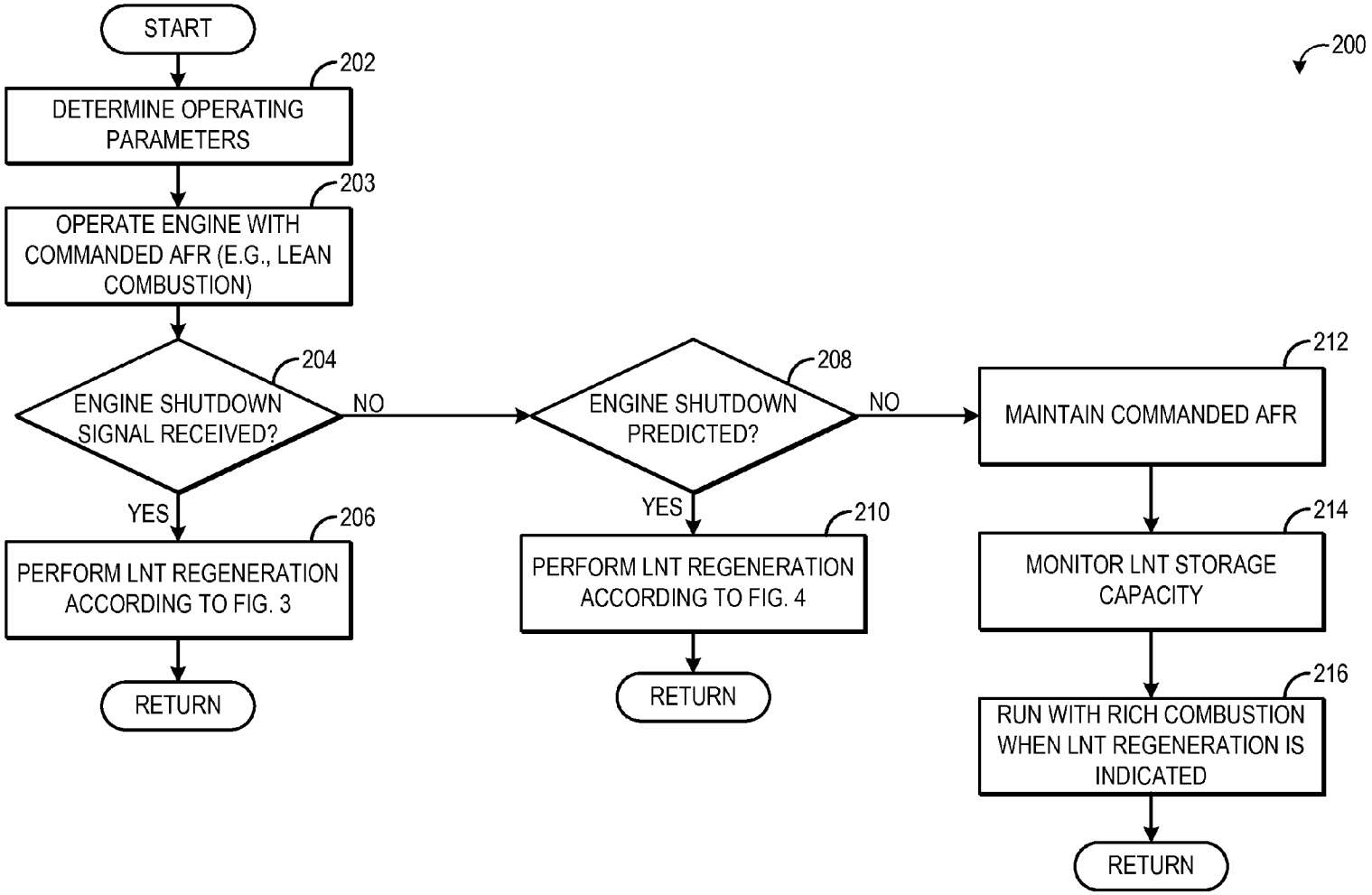
FIGS. 2-4 are a flow charts illustrating methods for operating an engine according to embodiments of the present disclosure.

FIG. 2 is a flow chart illustrating a high-level method 200 for performing a regeneration, or purge, of a lean NOx trap. Method 200 may be performed by an engine controller, such as engine control device 27 of FIG. 1, according to instructions stored thereon. Method 200 proactively purges NOx from a lean NOx trap (such as lean NOx trap 17) responsive to an engine shut down condition, resulting in an increased NOx storage capacity during a subsequent engine start.

Method 200 includes, at 202, determining engine operating parameters. The engine operating parameters determined may include, but are not limited to, engine speed and load, driver-requested torque, exhaust oxygen concentration (both upstream and downstream of the LNT), exhaust NOx concentration, and engine running status (e.g., whether the engine is operating, if an engine shutdown has been requested, etc.). At 203, the engine is operated with the commanded air-fuel ratio (AFR). In one example, the engine is a diesel engine configured to operate with lean combustion during standard engine operating conditions. Standard engine operating conditions may include engine operation without a requested or predicted engine shutdown, and without regeneration of a downstream exhaust treatment device, such as a lean NOx trap.

At 204, it is determined if an engine shut down signal has been received. The engine shut down signal may include an indication that the driver has requested the engine to be shut down, such as detection of an ignition key-off event. If an engine shut down signal has been received, method 200 proceeds to 206 to perform a regeneration of the LNT. Additional details of performing the regeneration of the LNT in response to an engine shut down request will be provided below with respect to FIG. 3. Method 200 then returns.

Returning to 204, if it is determined that an engine shut down signal has not been received, method 200 proceeds to 208 to determine if an engine shut down is predicted within a given period of time. For example, a navigation system may output a signal indicating that a desired destination has been reached. As such, it may be predicted that the engine will be shut down within a given amount of time (e.g., 10 seconds). In another example, a parking aide system may be activated, indicating that the vehicle is being parked and thus engine shutdown is predicted following completion of vehicle parking. Other mechanisms for predicting engine shutdown include one or more of the vehicle transmission being placed into park, a parking brake being activated, and adjustment or shutdown of auxiliary devices (e.g., windshield wipers turned off, windows rolled up, etc.).

If an engine shut down is predicted, method 200 proceeds to 210 to perform a regeneration of the LNT, according to the method presented below with respect to FIG. 4. Method 200 then returns. Returning to 208, if it is determined that an engine shutdown is not predicted, method 200 proceeds to 212 to maintain the original commanded AFR. At 214, the storage capacity of the LNT is monitored, via information from one or more exhaust sensors, for example. At 216, the engine is operated with rich combustion when LNT regeneration is indicated (for example, when the LNT storage capacity reaches a maximum). Method 200 then returns.

Figure 3:
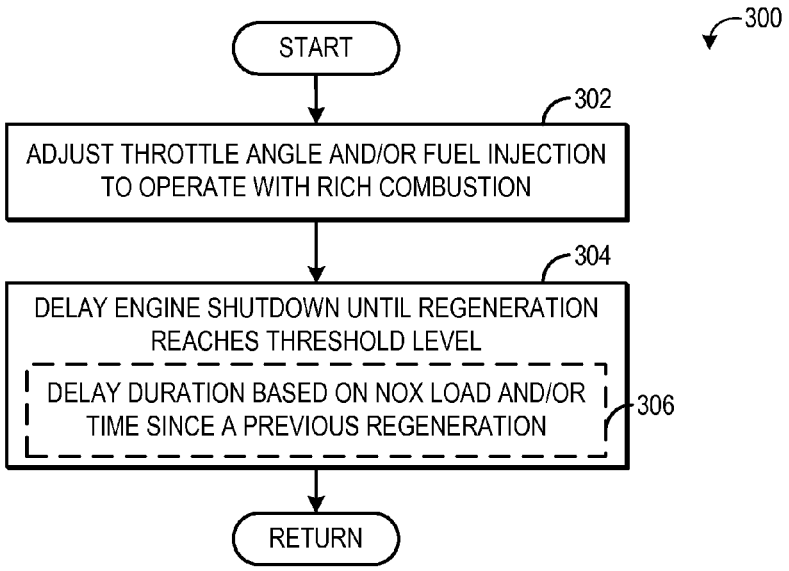

FIG. 3 is a flow chart illustrating a method 300 for regenerating a LNT in response to an engine shutdown signal (e.g., a key off event). Such a shutdown signal indicates that an engine shutdown has been requested by an operator or is otherwise about to occur (for example, the engine may be shutdown in response to an indication to switch into an electric mode if the vehicle is configured to operate with power from an engine and from a battery). In one example, method 300 may be performed following execution of method 200, when a shutdown signal is received.

At 302, method 300 includes adjusting a throttle angle and/or fuel injection amount to operate the engine with rich combustion. As explained previously, operation with rich combustion (e.g., AFR less than stoichiometry) results in conversion of stored NOx in the LNT.

At 304, engine shut down is delayed during the operation with rich combustion until the regeneration of the LNT reaches a threshold level. Exhaust gas constituents downstream of the LNT, such as oxygen and NOx, may be monitored via one or more sensors. Based on the output of the sensors, it may be determined that some or all of the stored NOx in the LNT has been purged. Once the NOx storage capacity of the LNT reaches a threshold, it may be determined that regeneration is complete and the engine may be shut down. For example, once the NOx storage capacity reaches 90%, it may be determined that the LNT regeneration is complete. In another example, completion of LNT regeneration may be based on an elapsed time since initiation of rich combustion, where after a given amount of time passes, it is assumed a majority of the NOx has been converted and purged from the LNT.

As such, the duration of the delayed shutdown may be dependent on a NOx level of the LNT and/or a time since a previous regeneration was performed, as indicated at 306. If the NOx level in the LNT is initially relatively high, the shutdown of the engine may be delayed by a longer amount of time than if the NOx level is relatively low. Similarly, if a LNT regeneration was performed relatively recently, the delay duration may be shorter than if a LNT regeneration was performed less recently. After the LNT is regenerated, the engine is shut down and method 300 returns.

Figure 4:
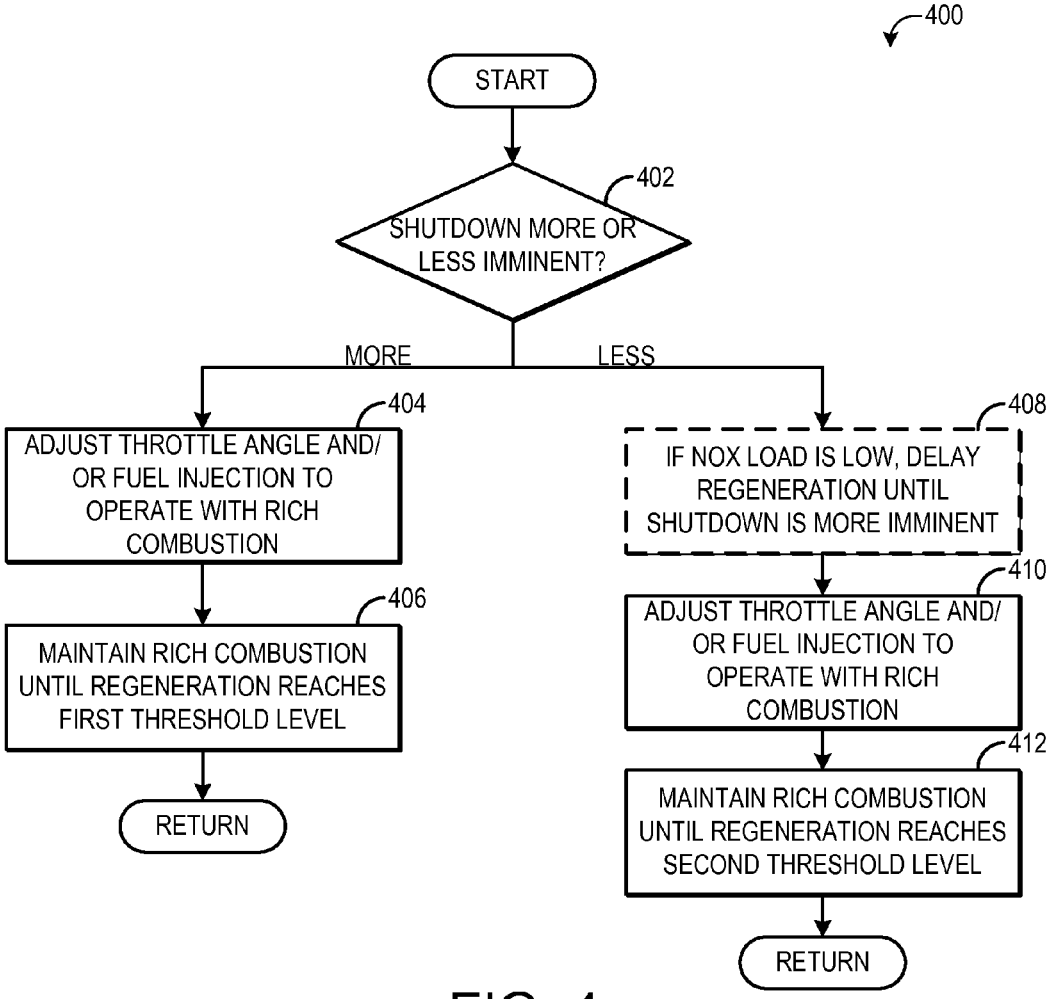

FIG. 4 is a flow chart illustrating a method 400 for regenerating a LNT in response to a predicted engine shutdown. A predicted engine shutdown, as explained previously, indicates that an engine shutdown is likely to occur given current vehicle conditions. Such conditions may include activation of a parking aid or assist system, indication that a desired destination has been reached, activation of parking brake, etc. In one example, method 400 may be performed following execution of method 200, when a shutdown is predicted.

At 402, method 400 determines if the shutdown is predicted to be more or less imminent. In one example, activation of a parking aid system may indicate shutdown is more imminent than indication that a desired destination has been reached. In another example, activation of the parking aid (or indication that a desired destination has been reached) may indicate shutdown is less imminent than if the parking aid is activated (or destination reached) and the vehicle is subsequently placed into park and the parking brake activated.

If shutdown is predicted to be more imminent (e.g., predicted to occur within five seconds), method 400 proceeds to 404 to operate with rich combustion to purge the LNT. At 406, the rich combustion operation is maintained until the LNT regeneration reaches a first threshold level. The first threshold level of regeneration may be a relatively high level in which a majority of the NOx in the LNT has been converted, such as 90% regeneration. Once the regeneration is complete, if an engine shutdown signal has been received (such as a key-off event is detected), the engine is shut down. If the engine shutdown signal is not received once the regeneration is complete, the original (e.g., non-regeneration) air-fuel ratio may be resumed until the engine is shut down. For example, the engine may be operated with lean combustion. Method 400 then returns.

If engine shutdown is predicted to be less imminent (e.g., predicted to occur within 10 seconds or more), method 400 proceeds to 408 to optionally delay regeneration until shutdown is more imminent. For example, if the parking aid is activated, regeneration may be delayed until the vehicle has actually been parked. Delay of the regeneration may be dependent on the NOx load on the LNT. For example, if the NOx load is high, the regeneration may not be delayed. If the NOx load is low, the regeneration may be delayed to allow as much NOx to be trapped in the LNT as possible prior to initiating the regeneration.

At 410, the throttle angle and/or fuel injection is adjusted to operate the engine with rich combustion. At 412, the rich combustion is maintained until the regeneration reaches a second threshold level. In some examples, the second threshold level may be equal to the first threshold level. In other examples, the second threshold level may a lower level of regeneration than the first regeneration level. In this way, if shutdown is less imminent, a shorter regeneration may Occur.

Furthermore, if the LNT is regenerated responsive to a predicted shutdown and the engine is not actually shutdown, the regeneration that would normally be performed at shutdown (according to the method 300 of FIG. 3, for example), may be dispensed with once the engine is actually shutdown.

Thus, the systems and methods described herein provide for a method for operating an engine. In one example, the method comprises during engine operation with non-shutdown conditions, operating the engine with lean combustion when a storage capacity of a lean NOx trap is below a threshold; and responsive to an engine shutdown condition, operating the engine with rich combustion.

In one example, the engine shutdown condition may comprise a key-off event. The method may further comprise delaying engine shutdown and operating the engine with rich combustion until regeneration of the lean NOx trap reaches a threshold level. In another example, the engine shutdown condition may comprise an indication that an engine shutdown is predicted within a given period of time, and operating the engine with rich combustion may comprise operating the engine with rich combustion until regeneration of the lean NOx trap reaches a threshold level.

If the engine shutdown prediction is based on activation of the parking aid, the method may determine that engine shutdown is more imminent than if the engine shutdown prediction is based on the indication that the desired destination has been reached. As such, when the parking aid is activated, regeneration of the lean NOx trap may be performed until the regeneration reaches a first threshold level. When the navigation system indicates that the desired destination has been reached, the regeneration of the lean NOx trap may be performed until the regeneration reaches a second threshold level. The second threshold level may be lower than the first threshold level (e.g., less NOx may be converted at the second threshold level than the first, or the regeneration may be carried out for a shorter amount of time at the second threshold level than the first).

Determining the regeneration of the lean NOx trap has reached the threshold level may be based on output from one or more sensors positioned in an exhaust path downstream of the lean NOx trap and/or based on an elapsed time since initiation of the operation with rich combustion. Predicting that the engine shutdown will occur within the given period of time may be based on activation of a parking aid and/or an indication from a navigation system that a desired destination has been reached.

The method may further comprise, during engine operation with non-shutdown conditions, operating the engine with rich combustion when the storage capacity of the lean NOx trap is above the threshold.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine, comprising:

during engine operation with non-shutdown conditions, operating the engine with lean combustion when an NOx storage capacity of a lean NOx trap is below a threshold;

responsive to an engine shut down signal being detected, delaying engine shutdown and operating the engine with rich combustion until regeneration of the lean NOx trap reaches a threshold level; and responsive to the engine shut down signal not being detected, determining that an engine shutdown is expected within a given period of time and operating the engine with rich combustion until regeneration of the lean NOx trap reaches the threshold level.

2. The method of claim 1, wherein operating the engine with rich combustion until regeneration of the lean NOx trap reaches the threshold level comprises operating the engine with rich combustion until regeneration of the lean NOx trap reaches a first threshold level.

3. The method of claim 2, wherein determining that the engine shutdown is expected within the given period of time is based on an indication from a navigation system that a desired destination has been reached, and wherein operating the engine with rich combustion until regeneration of the lean NOx trap reaches the threshold level further comprises operating the engine with rich combustion until regeneration of the lean NOx trap reaches a second threshold level, lower than the first threshold level.

4. The method of claim 1, further comprising determining the regeneration of the lean NOx trap has reached the threshold level based on output from a sensor positioned in an exhaust path downstream of the lean NOx trap.

5. The method of claim 1, further comprising determining the regeneration of the lean NOx trap has reached the threshold level based on an elapsed time since initiation of the operation with rich combustion.

6. The method of claim 1, further comprising during engine operation with non-shutdown conditions, operating the engine with rich combustion when the storage capacity of the lean NOx trap is above the threshold.

* * * * *